US005457829A

United States Patent [19]

Elliott

[11] Patent Number: 5,457,829

[45] Date of Patent: Oct. 17, 1995

[54] CONVERTIBLE COMFORTER AND PILLOW

[75] Inventor: John K. Elliott, Orange, Calif.

[73] Assignee: Arrow Industries, Inc., Anaheim, Calif.

[21] Appl. No.: 113,268

[22] Filed: Aug. 27, 1993

[51] Int. Cl.[6] ..... A47G 9/02

[52] U.S. Cl. ..... 5/420; 5/485; 5/490

[58] Field of Search ..... 5/413, 417, 420, 5/485, 490, 502, 419

[56] References Cited

U.S. PATENT DOCUMENTS

| | | | |
|---|---|---|---|
| D. 258,035 | 1/1981 | Fenwick | D6/267 |
| 1,269,276 | 6/1918 | Harris . | |
| 2,045,784 | 6/1936 | Leve | 5/419 |
| 2,183,418 | 12/1939 | Williams . | |
| 2,344,010 | 3/1944 | Walsh | 5/417 X |
| 2,898,609 | 8/1959 | Storie | 5/419 |
| 3,774,249 | 11/1973 | Ybarra et al. | 5/419 |
| 4,375,111 | 3/1983 | Hall | 5/420 X |
| 4,516,668 | 5/1985 | Grayck | 5/417 X |
| 4,590,633 | 5/1986 | Pickens | 5/482 |
| 4,634,618 | 1/1987 | Greer et al. | 5/417 X |
| 4,754,512 | 7/1988 | Chao-Yang | 5/482 |
| 4,856,131 | 8/1989 | Mills | 5/413 |
| 5,179,741 | 1/1993 | Book | 5/417 |

FOREIGN PATENT DOCUMENTS

| | | | |
|---|---|---|---|
| 484456 | 3/1938 | United Kingdom | 5/485 |

*Primary Examiner*—Michael F. Trettel
*Attorney, Agent, or Firm*—James G. O'Neill

[57] ABSTRACT

An improved comforter having a pocket which is permanently secured to one side thereof in a position located substantially centrally along one side edge, and which pocket is shaped and dimensioned so as to be turned inside out and have the comforter folded, rolled and tucked into the inside out pocket to form a standard size pillow, without utilizing fastening means, and which will fit into a standard size pillow case.

20 Claims, 2 Drawing Sheets

CONVERTIBLE COMFORTER AND PILLOW

BACKGROUND OF THE INVENTION

1. Field of the Invention

This invention relates generally to comforters, and more particularly, to an improved comforter that is easily converted into a standard size pillow.

2. Description of Related Art

Various blankets, coverlets, pillow kits, sleeping bags and toys are known which contain pockets for storing items, may be used to cover pillows, or which may be converted into pillows by the use of strings, zippers or other fastening means. These known means usually include a separate cover, or the like, which may be converted and or extended from, or retracted into a body, wherein it is fastened in position by actuation of a cooperating fastening means. However, the cost of manufacture and assembly of the many different parts of such known means is high, particularly when compared to the low cost of manufacturing and assembling, the present invention, having fewer parts, and no external or internal fastening means.

One such prior art coverlet that is convertible into a pillow is disclosed in U.S. Pat. No. 2,183,418 to Williams. This coverlet contains a filling, is quilted, and includes an unquilted portion of material D, extending completely across and over one end of the coverlet, forming a pocket that is of a suitable size to receive all of the coverlet when it is folded a predetermined number of times. The coverlet is also provided with a zipper E which extends from a center point F at the open edge of the pocket and around the sides G and H of the pocket. The operator I for the zipper is normally at the center point F so that when the folded sections are tucked into the pocket, and the pocket D is then folded upon itself from the center point F, the adjacent portions of the zipper E will be in operative relation to each other, to allow the operator I to be moved to lock the zipper together around three sides, thereby converting the coverlet into a pillow. FIG. 10 of this patent shows the sections of the coverlet folded and tucked into the pocket D, while FIG. 11 illustrates the pocketed sections folded before the operator I is manipulated to secure the sections together to form the final pillow. Although this patent discloses a coverlet with a pocket that may be formed into a pillow, it requires that the pocket be across the entire width of the coverlet, that the pocket be folded after it is filled with the folded coverlet, and a zipper to keep the folded sections of the pillow together. The zipper adds to the complexity and cost in manufacturing and cleaning this coverlet, and, includes teeth and an extending operator that might harm small children or others using the coverlet.

Other known prior art means, are shown in the following U.S. Pat. Nos. Des. 258,035 which discloses a blanket with pockets at one end to store items; 1,269,276 which discloses a waterproof pillow covering means having interior pockets therein for storing items when the cover is placed over filling or a pillow and tied at its ends by pull string means; 4,590,633 which discloses a doll having a pocket with a blanket attached therein for storage or removal when it is to be used; 4,754,512 which discloses a toy in the shape of an animal having an opening to a cavity having an inflatable air cell, and a blanket that is releasably held to the toy and capable of being rolled into and out of the cavity in the toy; 4,856,131 which discloses a sleeping bag that may be converted into a doll; and 5,179,741 which discloses an infant blanket that may be converted into a pillow and secured in this pillow position by a zipper located centrally on one side of the blanket. However, these prior art designs usually contain some type of fastening means, and are not as user friendly as the present invention, since they tend to be more cumbersome to use, contain more elements, and are not as cheaply or easily manufactured. Therefore, there still exists a long felt need in the art for a dependable, easily used convertible comforter which is of high quality, but relatively low in cost, easy to manufacture, and which overcomes the problems set forth above.

SUMMARY OF THE INVENTION

Accordingly, it is a general object of the present invention to provide an improved convertible comforter and pillow.

It is a particular object of the present invention to provide an improved, high quality, comforter of a specific thickness which converts into a pillow of standard size.

It is a still more particular object of the present invention to provide an improved, high quality, comforter which is easily converted into a standard size pillow which may be slipped into a standard size pillow case.

It is yet a more particular object of the present invention to provide an improved convertible comforter and pillow requiring no exterior hardware, straps or strings for conversion and or to fasten the pillow in position.

It is a further particular object of the present invention to provide an improved, high quality, comforter having a pocket which can accommodate a standard size pillow or the feet of a user.

It is yet another particular object of the present invention to provide an improved, high quality, comforter having a pocket which allows the comforter to be used on either side.

And, it is a final particular object of the present invention to provide a high quality, comforter having a pocket which is specifically designed and placed so as to be turned inside out to allow the comforter to be easily folded, rolled and tucked into the inside out pocket so as to be changed from a comforter to a pillow.

In accordance with one aspect of the present invention, there is provided an improved comforter having a pocket which is permanently secured thereto in a position substantially centrally along one side edge thereof, and which pocket is shaped and dimensioned so as to be capable of allowing the comforter to be folded and rolled into the pocket to form a standard size pillow, without utilizing fastening means. The formed pillow fits into a standard size pillow case.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved comforter which may be easily converted to a pillow and back, identified generally at 10.

Figure 1:
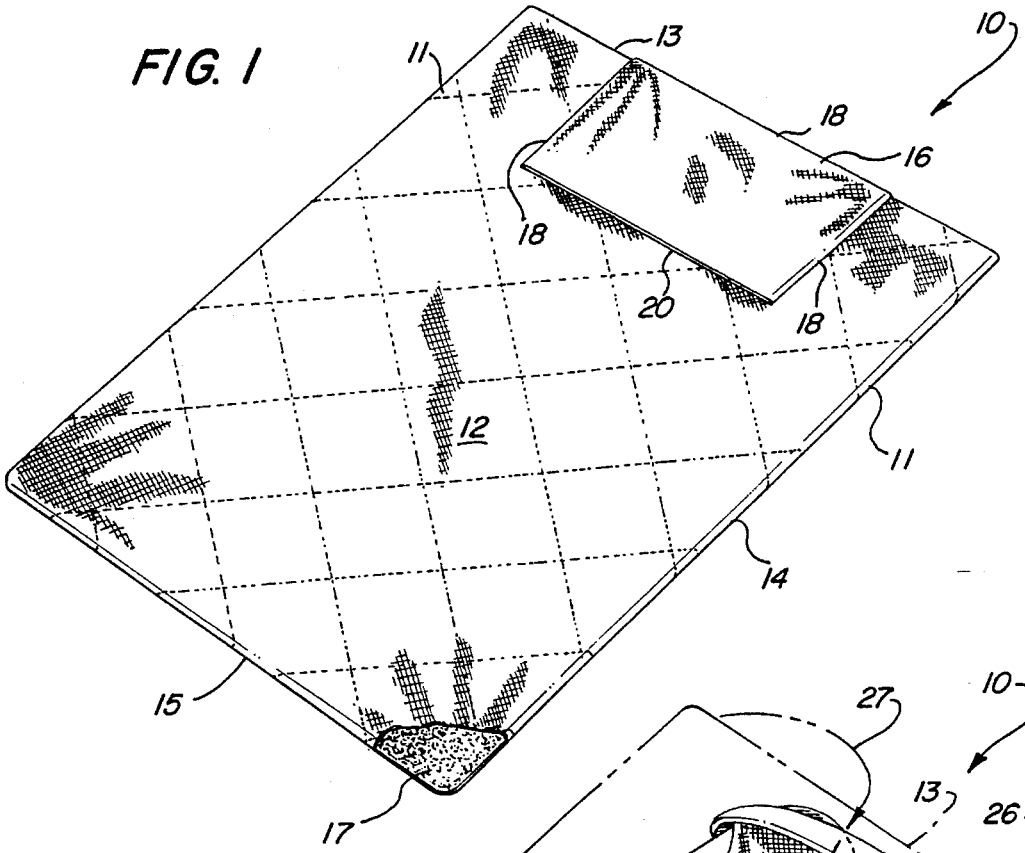
FIG. 1 is an isometric view of an improved convertible, comforter and pillow of the present invention, showing partially in section the filling thereof.
Figure 2:
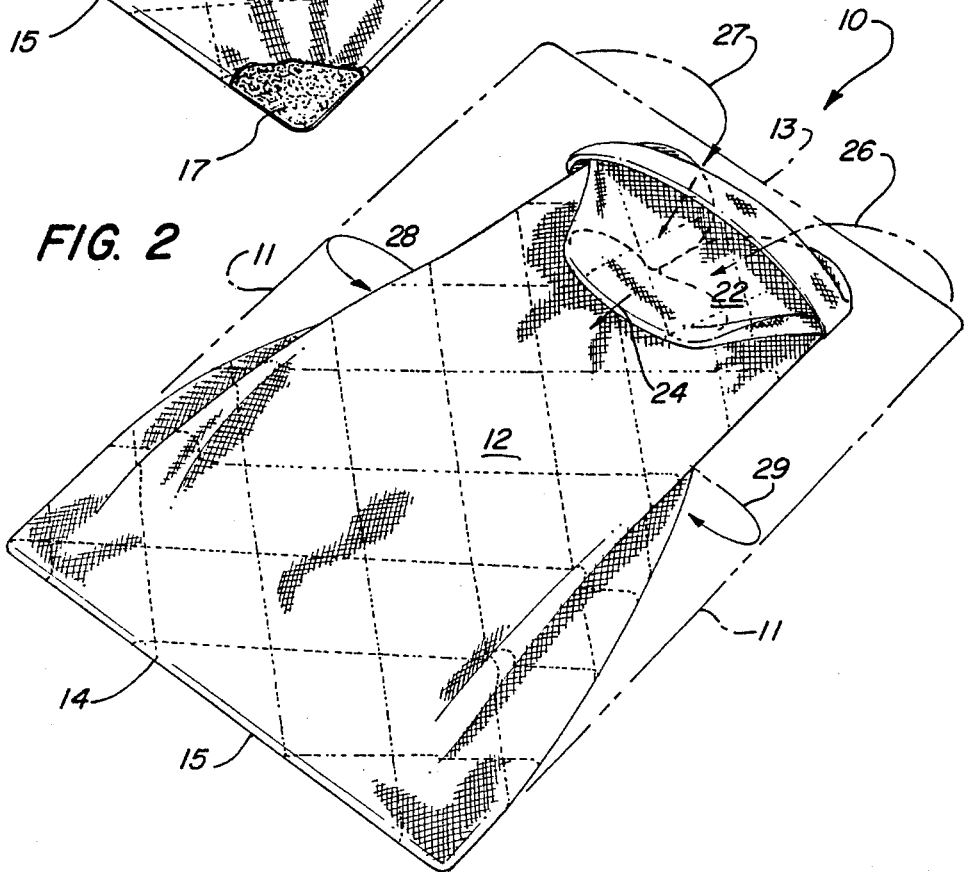
FIG. 2 is a further isometric view, similar to FIG. 1, with a pocket formed on the comforter turned inside out and the sides of the comforter moved inwardly from their extended positions, to start the conversion of the comforter to a pillow.

The comforter 10 may be any standard size to fit any size bed, such as king, queen, etc., but will be herein described as a substantially rectangular standard twin size bed comforter (63"×86") having two long edges 11 and two shorter edges 13, 15. The comforter is made in a manner known to those skilled in the art, and preferably includes an internal stuffing or fill 17, of a specific thickness, described below, held in place in a hollow chamber by quilting. The comforter includes a front face or side 12, shown most clearly in FIG. 1, and a rear face or side 14, secured together to form the hollow chamber and securely hold the filling 17 therein. A substantially rectangular pocket 16 is formed from a substantially rectangular piece of unquilted material, which may be filled or unfilled, fixed to front face or side 12, substantially centrally of the shorter edge 13, along 3 side edges 18, as by sewing, or any other known manner. The material forming the pocket and therefore the pocket 16 is substantially shorter than the shorter edge 13, and includes a fourth, open side edge 20, substantially parallel to the side edge 18 secured to edge 13, for insertion of a pillow, or the feet of a person lying on the comforter. Furthermore, this pocket 16 is specifically designed and positioned to enable the comforter to be converted, as by folding, rolling and tucking, into a pillow, as described more fully below. The formed pocket 16 may be of any desired size, and in the twin bed size described herein preferably includes an interior space approximately 30 inches long and 20 inches wide so as to allow a standard size pillow (20"×30") to be inserted and held therein, and to form substantially the same standard size pillow when the comforter is converted into a pillow. It being understood, of course, that a standard size pillow for a king size bed is 20"×40", and that other standard size pillows will also vary from the 20"×30" size.

Turning now to FIGS. 2–6, the method of converting the comforter into a pillow and back to a comforter will be described. First, however, it should be pointed out that the thickness of the comforter is critical. That is, the comforter must be of a predetermined thickness, arrived at by utilizing a specific thickness of fill 17. This enables a comfortable, high quality, comforter to be formed that, when folded and rolled into a pillow, will also form a pillow of substantially the same size and loft (fluffiness) as a standard size pillow. Therefore, when fabricating a twin size comforter, the fill 17 selected is a preferably a bonded polyester fiber having a weight of 5.5 ounces per square yard. However, depending on the coarseness of the fiber used, as well as other variables, such as the size of the comforter, the weight may vary between the range of 4 to 7 ounces per square yard, so as to provide the necessary loft to the comforter and the pillow formed therefrom, when the comforter is converted into a selected, standard size pillow.

Figure 3:
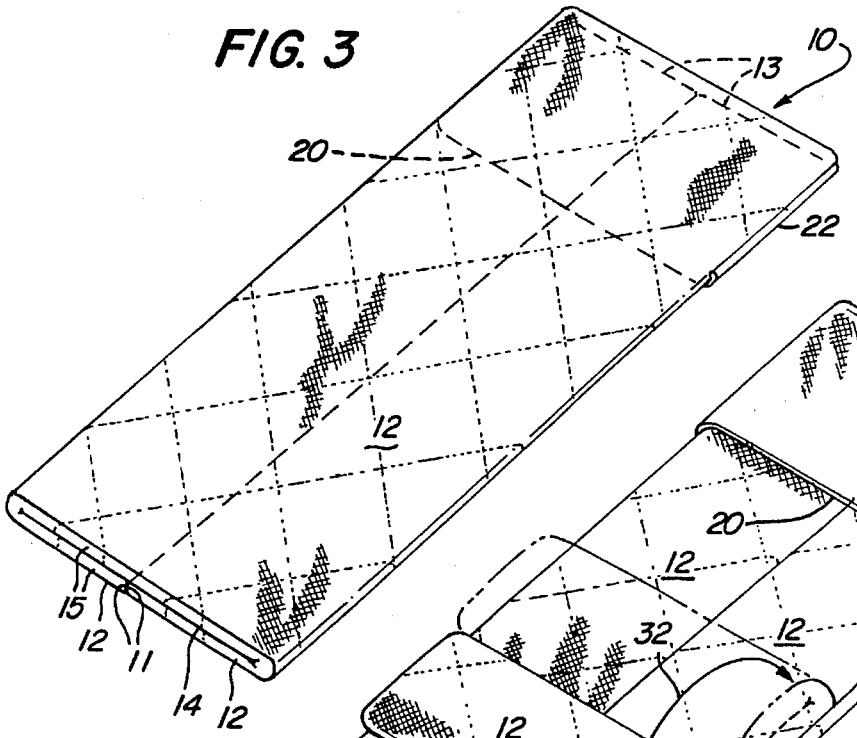
FIG. 3 is a still further isometric view, looking in the same direction as FIG. 2, with the sides of the comforter folded into parallel positions, against the opposite side of the comforter, with the ends of each folded side held, or tucked in the inside out pocket.
Figure 4:
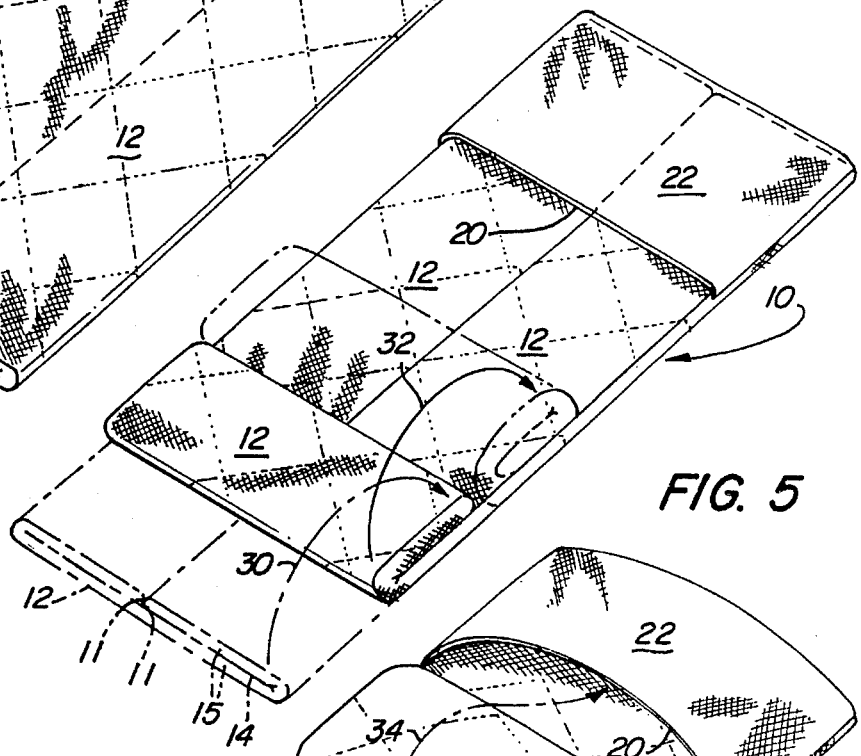
FIG. 4 is a still further isometric view, showing the reverse side of FIG. 2, and further illustrating how the folded comforter is rolled up.
Figure 5:
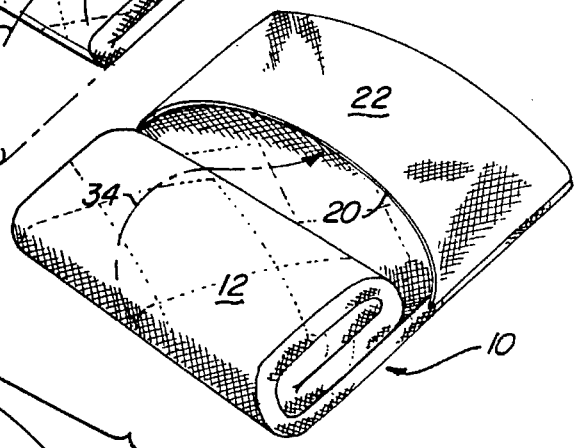
FIG. 5 is a still further isometric view, similar to FIG. 4, showing the comforter substantially rolled up and ready for insertion into the inside out pocket.
Figure 6:
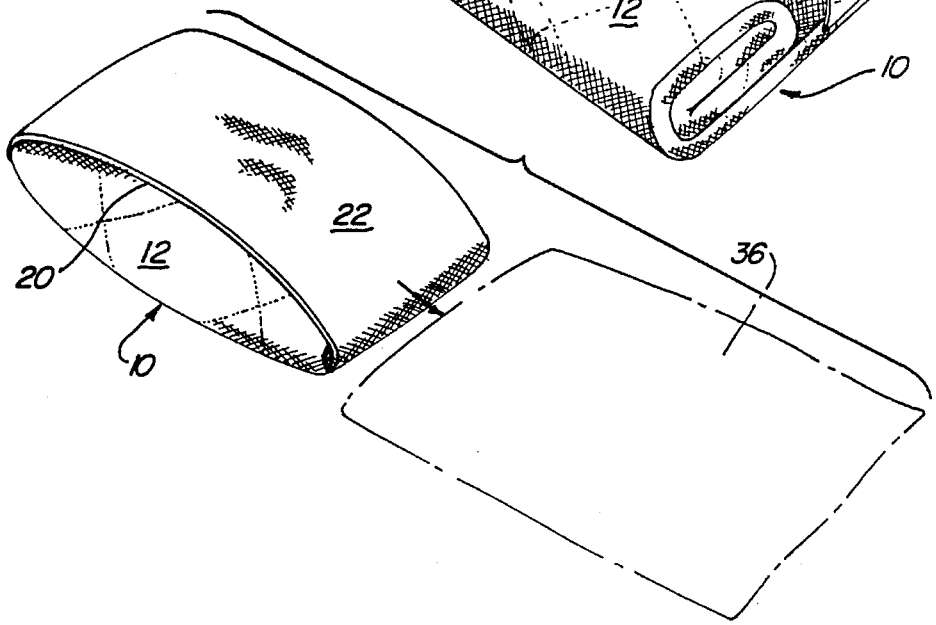
FIG. 6 is a still further isometric view, showing the comforter tucked into the pocket to form a pillow, with a standard pillow case shown in broken line for insertion over the pillow.

After forming the comforter 10 with the sides 12 and 14 and required fill 17, the comforter is converted to a pillow as follows:

1. The pocket 16 is first turned inside out by pulling out interior 22 of the pocket, in the direction of the arrow 24, shown in FIG. 2, thereby forming an inside out or further pocket 22. As the interior 22 is being pulled out, and the pocket 16 being turned inside out, the portion of the shorter edge 13 along which side edge 18 of pocket 16 is secured will be pulled into the newly formed pocket 22 (inside out old pocket), in the direction of the arrows 26 and 27.
2. The longer edges 11 of the comforter will be pulled toward and may then be folded over, in the direction of the arrows 28 and 29, until they are parallel with each other, as they lie against the rear surface 14, as shown in FIGS. 3 and 4. The free or outer ends of the shorter edge 13, also pulled into the interior of the newly formed pocket are then tucked into and held in the positions in pocket 22, as also shown in FIGS. 3 and 4. In this manner, it can be seen that the rear surface 14 of the comforter 10 is entirely covered by the front surface 12 and a substantially narrower and thicker intermediate comforter or item has been formed.
3. The narrower and thicker intermediate comforter is now turned over so that the newly formed pocket 22 is up, as shown in FIG. 4. The free shorter edge 15 is then rolled, in the direction of the arrows 30 and 32 toward the shorter edge 13, as shown in FIG. 4, until it is substantially rolled up, as shown in FIG. 5.
4. The rolled up comforter is then tucked into the pocket 22, in the direction of the arrow 34, as shown in FIG. 5, and the pillow shaken or adjusted, if necessary, to smooth it out and form a complete, standard size pillow, as show in FIG. 6. If desired, the formed pillow may then be inserted into a standard size pillow case 36, for protection, storage, or for transporting the same.

The steps described above are easily reversed if the pillow is to be made back into a comforter.

It, therefore, can be seen that the present invention provides a new and improved, high quality and relatively low-cost comforter which may be used with either side up or down, and which may be easily converted from the comforter to a pillow and back, by turning a pocket formed on one side thereof inside out, and quickly and easily rolling and tucking the comforter into the inside out pocket to form the pillow. The pillow is held in position or shape without the need for any fastening means, and is easily turned back into a comforter by merely reversing the steps of forming the same.

Those skilled in the art will appreciate that the above-described preferred embodiments are subject to numerous modifications and adaptations without departing from the scope and spirit of the invention. Therefore, it is to be understood that, within the scope of the appended claims, the invention may be practiced other than as specifically described herein.

What is claimed is:

1. A comforter convertible to a pillow comprising:

a substantially rectangular first side and a substantially rectangular second side secured together to form a substantially rectangular comforter having a hollow chamber with a filling of a predetermined thickness therein;

said filling being held in place in said hollow chamber by quilting;

said substantially rectangular comforter with said filling secured therein having two long edges and two shorter edges; and a substantially rectangular, unquilted portion of material having four side edges secured to one of said sides of said substantially rectangular comforter by three of the four sides edges, along one of the shorter edges, and being sized and shaped so as to form a single pocket which is substantially shorter than said shorter edge to which it is secured; the fourth of said four side edges being unsecured so as to form an opening into said pocket and facing toward the other of the shorter edges.

2. The comforter convertible to a pillow of claim 1 wherein said pocket on said one side of said substantially rectangular comforter is dimensioned, placed and sized so as to be capable of being turned inside out to receive and hold the remainder of said substantially rectangular comforter when said substantially rectangular comforter is folded, rolled and tucked into said turned inside out pocket.

3. The comforter convertible to a pillow of claim 2 wherein said pillow formed when said substantially rectangular comforter is folded, rolled and tucked into said turned inside out pocket is a standard size pillow, adapted to fit into a standard size pillow case.

4. The comforter convertible to a pillow of claim 3 wherein said filling in said hollow central opening is a bonded polyester fiber having a weight in the range of 4 to 7 ounces per square yard.

5. The comforter convertible to a pillow of claim 4 wherein said substantially rectangular, unquilted portion of material is filled.

6. The comforter convertible to a pillow of claim 4 wherein said substantially rectangular, unquilted portion of material is unfilled.

7. The comforter convertible to a pillow of claim 3 wherein said standard size pillow is approximately 20"×30".

8. The comforter convertible to a pillow of claim 7 wherein said filling in said hollow central opening is a bonded polyester fiber having a weight from 4 to 7 ounces per square yard.

9. A method of forming a pillow from a comforter comprising the steps of:

forming a comforter with two sides, two long edges and two shorter edges having a filling secured therein, and a pocket secured to one side thereof, along one of the two shorter edges;

turning the pocket inside out by pulling out the interior of the pocket;

tucking the ends of the shorter edge along which the pocket is secured into the inside out pocket;

folding the two longer edges until they are parallel with each other, as they lie against the other side of the comforter;

turning over the comforter with the ends of the shorter edge tucked into the inside out pocket;

rolling up the other of the shorter edges toward the inside out pocket; and tucking the rolled up material into the inside out pocket to form a pillow.

10. The method of claim 9, including the further step of shaking the pillow so as to complete the formation of a standard size pillow.

11. The method of claim 9, including the further step of filling the material used to form said pocket, and forming said filling in said comforter and said material forming said pocket from a bonded polyester fiber having a weight from 4 to 7 ounces per square yard.

12. The method of claim 11, including the further step of inserting said pillow into a standard size pillow case.

13. The method of claim 9, including the further step of forming said pocket from an unquilted unfilled material, dimensioned so that it is substantially shorter than the edge to which it is secured.

14. The method of claim 13, including the further step of shaking the pillow so as to complete the formation of a standard size pillow.

15. The method of claim 14, including the further step of forming said filling in said comforter from a bonded polyester fiber having a weight in the range from 4 to 7 ounces per square yard.

16. The method of claim 15, including the further step of inserting said pillow into a standard size pillow case.

17. A comforter convertible to a pillow comprising:

a substantially rectangular first side of material secured to a substantially rectangular second side of material to form a substantially rectangular comforter having a hollow chamber with a filling of a predetermined thickness comprised of a bonded polyester fiber having a weight of approximately 5.5 ounces per square yard therein;

said filling being held in place in said hollow chamber by quilting;

said substantially rectangular comforter with said filling secured therein having two long edges and two shorter edges; and a substantially rectangular, unquilted portion of material having four side edges secured to one of said sides of said substantially rectangular comforter by three of the four sides edges, substantially centrally along one of the shorter edges, and being sized and shaped so as to form a single pocket which is substantially shorter than said shorter edge to which it is secured; the fourth of said four side edges being unsecured so as to form an opening into said pocket and facing toward the other of the shorter edges into which a standard size pillow may be inserted and held.

18. The comforter convertible to a pillow of claim 17 wherein said pocket on said one side of said substantially rectangular comforter is dimensioned, placed and sized so as to be capable of being turned inside out to receive and hold the remainder of said substantially rectangular comforter when said substantially rectangular comforter is folded, rolled and tucked into said turned inside out pocket to form a standard size pillow, adapted to fit into a standard size pillow case.

19. The comforter convertible to a pillow of claim 18 wherein said substantially rectangular, unquilted portion of material is filled and said formed standard size pillow is 20"× 30".

20. The comforter convertible to a pillow of claim 18 wherein said substantially rectangular, unquilted portion of material is unfilled and said formed standard size pillow is 20"×30".

* * * * *